US006973943B2

(12) United States Patent
Sesek et al.

(10) Patent No.: US 6,973,943 B2
(45) Date of Patent: Dec. 13, 2005

(54) INK CARTRIDGE REFILLING SYSTEM

(75) Inventors: Robert M. Sesek, Meridian, ID (US); Travis J. Parry, Boise, ID (US); Curtis Reese, Boise, ID (US); Daniel T. Lay, Meridian, ID (US); Christopher C. Westlake, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/796,513

(22) Filed: Mar. 8, 2004

(65) Prior Publication Data

US 2004/0169707 A1 Sep. 2, 2004

Related U.S. Application Data

(63) Continuation of application No. 10/235,471, filed on Sep. 4, 2002, now Pat. No. 6,729,360.

(51) Int. Cl.[7] ..... B65B 1/04

(52) U.S. Cl. ..... 141/18; 141/100; 141/94; 141/83; 347/85

(58) Field of Search ..... 141/2, 18, 9, 100, 141/104, 94, 83; 347/84–87

(56) References Cited

U.S. PATENT DOCUMENTS

| | | | | |
|---|---|---|---|---|
| 5,203,387 | A | 4/1993 | Howlett | |
| 5,704,403 | A | 1/1998 | Schwenk | |
| 5,801,735 | A | 9/1998 | Lorenze | |
| 6,273,151 | B1 * | 8/2001 | Kong | 141/18 |
| 6,547,363 | B1 | 4/2003 | Shinada | |

* cited by examiner

*Primary Examiner*—Steven O. Douglas

(57) ABSTRACT

An ink cartridge refilling station incorporates a receptacle for receiving an ink cartridge, a supply of ink and a refilling mechanism for automatically adding ink to the ink cartridge from the supply of ink. An ink cartridge, for use with the cartridge refilling station, includes a reservoir for holding a supply of ink and an input port communicating with the reservoir, the port being configured to receive ink from the automated ink refilling station.

14 Claims, 6 Drawing Sheets

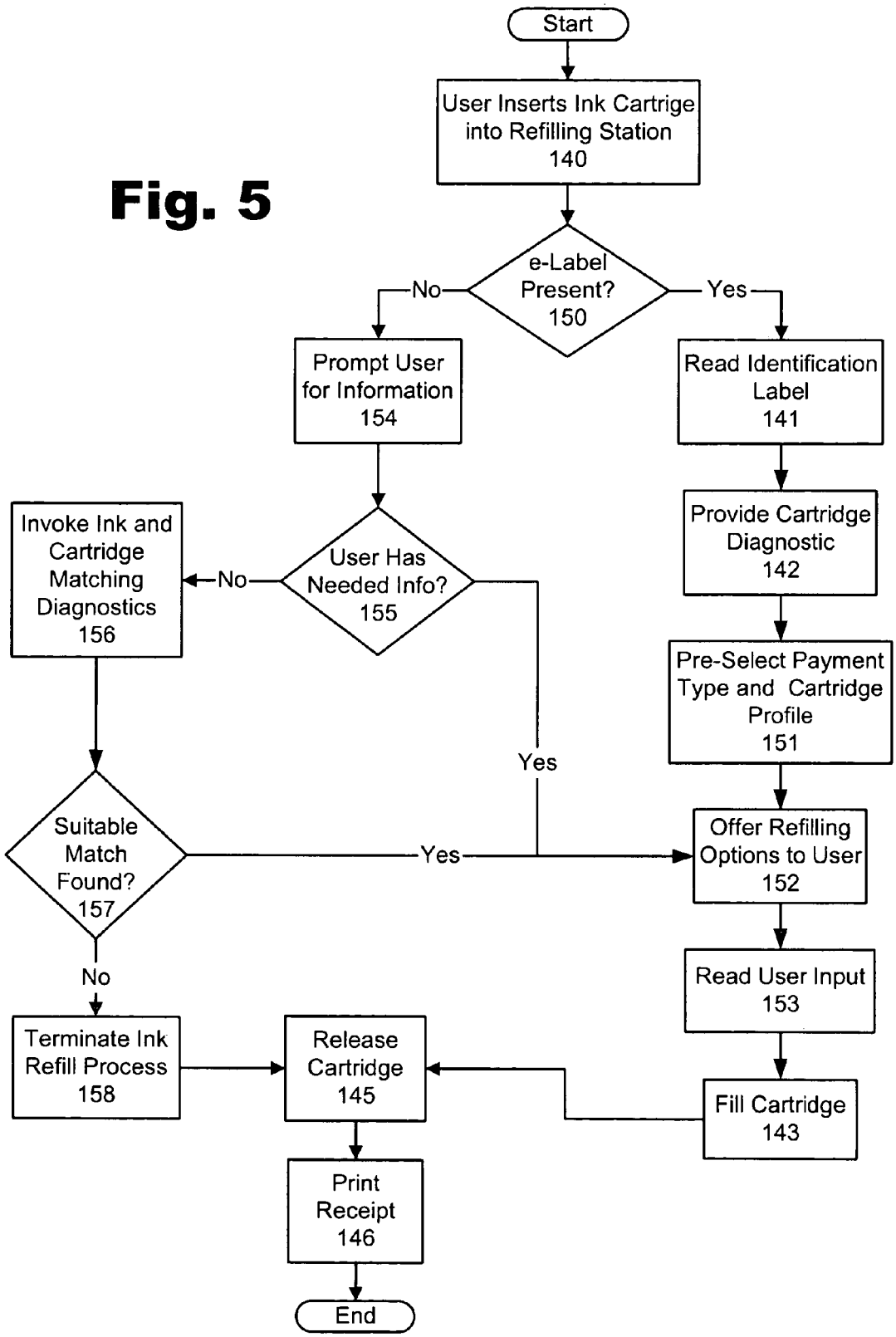
Fig. 5
Start
User Inserts Ink Cartrige into Refilling Station 140
e-Label Present? 150
No
Yes
Prompt User for Information 154
Read Identification Label 141
Provide Cartridge Diagnostic 142
Pre-Select Payment Type and Cartridge Profile 151
Offer Refilling Options to User 152
Read User Input 153
Fill Cartridge 143
User Has Needed Info? 155
No
Yes
Invoke Ink and Cartridge Matching Diagnostics 156
Suitable Match Found? 157
Yes
No
Terminate Ink Refill Process 158
Release Cartridge 145
Print Receipt 146
End

INK CARTRIDGE REFILLING SYSTEM

RELATED APPLICATIONS

The present application is continuation of, and claims priority from, U.S. patent application Ser. No. 10/235,471 now U.S. Pat. No. 6,729,360, filed Sep. 4, 2002, which is incorporated herein in its entirety.

FIELD

The present invention relates to ink cartridges. More particularly the present invention relates to an automated refilling station for adding ink to printing device ink cartridges.

BACKGROUND

Printers and printing devices are used to print one or more hard copies of electronic data. Printing devices typically rely on replaceable printing cartridges to supply the required ink or printing fluid for such print jobs. Examples of printing devices that use printing cartridges include laser printers, inkjet printers, fax machines, copiers, and multifunction peripherals.

As used herein and in the attached claims, the expendable material used by a printing device to render a print job on a print medium, whether that material is, for example, ink, toner, or printing fluid, will be referred to collectively as "ink." Similarly, an ink cartridge is defined as a storage device that holds and dispenses ink when engaged in a printing device. As used herein, the term "printer" or "printing device" refers broadly to any device that makes use of a printing cartridge for a supply of ink.

Printing devices can print monochrome or color documents. In some cases, an ink cartridge may contain only black ink (K) for a monochrome printer. The ink cartridge for a color printer will typically hold four or more differently colored inks. Typical color printers use one cartridge that holds only black ink (K) and a second cartridge that contains three different colors of ink that can be blended to produce any color in the spectrum. The three colors most often used are cyan (C), magenta (M), and yellow (Y). Individual colors may also be provided via individual cartridges.

As the printing process consumes the ink in a printing cartridge, the cartridge must be replaced or refilled. Presently, the use of computers and printing devices is constantly increasing. Thus, there is a proportional increase in the demand for ink and printing cartridges.

Most users simply buy an entirely new print cartridge when the ink cartridge in use is emptied. Ordering a new cartridge may be an expensive and time-consuming process for the user. Additionally, the hardware of a cartridge may still be completely serviceable even after the supply of ink in the cartridge has been expended. Many cartridges are unnecessarily thrown away because the user is unable to reuse the ink cartridge.

Consequently, some users attempt to refill the cartridge with a new supply of ink. While there are presently do-it-yourself cartridge refilling systems available, these systems present some problems. Cartridge refilling kits are often very messy and provide ink that is not specifically designed for a given cartridge and printer. The use of Inferior ink may shorten the useful life of the cartridge, cause smearing, or poor print quality. Inferior ink may also damage the cartridge and/or the printing device in which it is used.

Some cartridges are designed to be refillable, while many are not. Refillable cartridges have a manufacturer specified useful life and designated methods of refilling the cartridge. However, the user may often be unaware of the manufacturer's recommendations. In such a case, the user may incorrectly fill the cartridge or attempt to use the cartridge beyond its useful life. Incorrect filling and using a cartridge beyond the useful life may cause some of the same problems noted above, e.g., degraded print quality and damage to the printing device.

SUMMARY

In one of many possible embodiments, the present invention provides an ink cartridge refilling station that incorporates a receptacle for receiving an ink cartridge, a supply of ink and a refilling mechanism for automatically adding ink to the ink cartridge from the supply of ink. An ink cartridge, for use with the cartridge refilling station, includes a reservoir for holding a supply of ink and an input port communicating with the reservoir, the port being configured to receive ink from the automated ink refilling station.

Additional advantages and novel features of the invention will be set forth in the description which follows or may be learned by those skilled in the art through reading these materials or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain the principles of the present invention. The illustrated embodiments are examples of the present invention and do not limit the scope of the invention.

FIG. 5 is a flowchart illustrating a method of operating the system illustrated in FIG. 2 in accordance with another embodiment of the present invention.

Throughout the drawings, identical reference numbers designate similar, but not necessarily identical, elements.

DETAILED DESCRIPTION OF THE PREFERRED EMBODIMENTS

Figure 2:
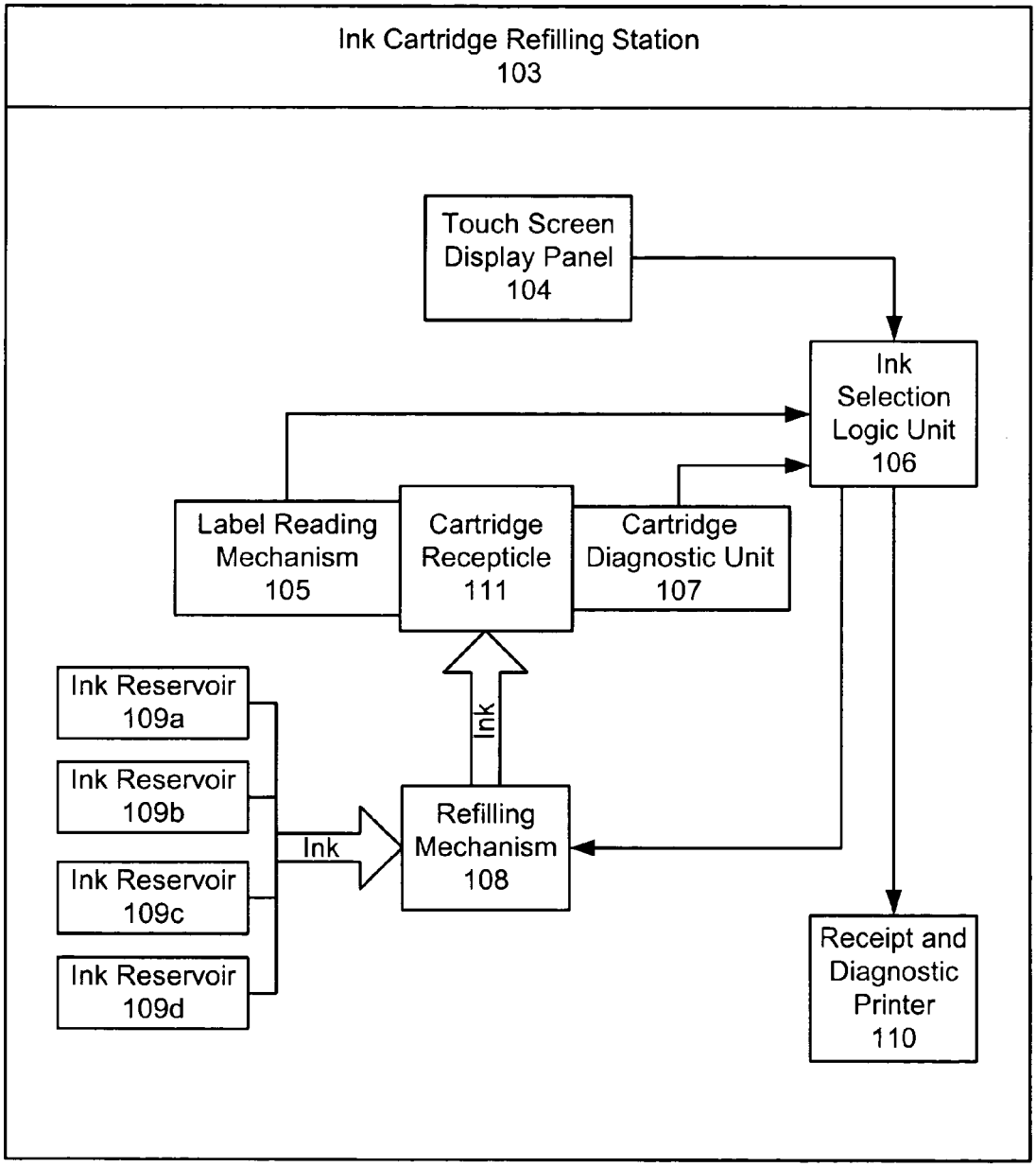
FIG. 2 is an illustration of a first embodiment of an ink cartridge refilling station according to the present invention.

In one of many possible embodiments, the present invention provides an ink cartridge refilling station (103; FIG. 2). The refilling station implements a method and provides a system that allows a user to add ink to a printing cartridge. The system may also use cartridge diagnostics and user input to decide the type and quantity of ink to add to the cartridge. Moreover, the system may ensure that the cartridge is operating properly within its useful life and does not pose a hazard to the printing device in which it will be used. In the figures shown open arrows labeled 'ink' indicate the flow of ink within the refilling station; the electronic signals internal to the refilling station (103) are represented by the thin solid arrows. The refilling station (103) may be incorporated in a kiosk that is publicly available, such as in a retail store for computer equipment.

Figure 1:
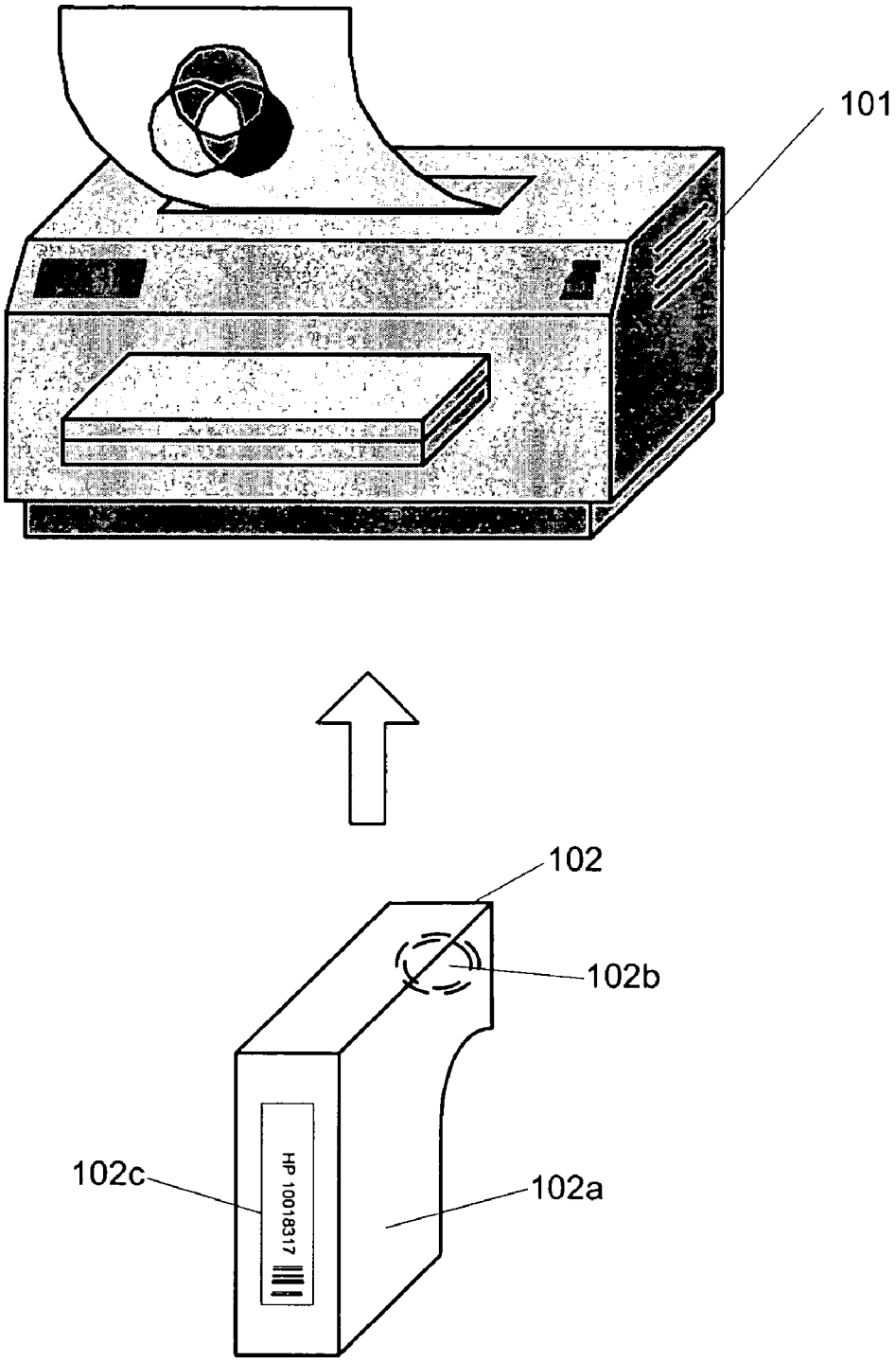
FIG. 1 is a perspective view of a printing device and the corresponding ink cartridge used by the printing device according to an embodiment of the present invention.

Using the drawings, the present invention will now be explained. FIG. 1 illustrates a printing device (101) and a corresponding ink cartridge (102). As shown in FIG. 1, the ink cartridge (102) is installed in the printing device (101) and is easily removed for refilling purposes. The ink cartridge (102) supplies the ink necessary for print jobs processed by the printing device (101).

The ink cartridge contains an ink reservoir (102*a*) that stores the ink within the cartridge (102). The ink cartridge reservoir (102*a*) may be a single reservoir or series of reservoirs. In the case of a color-printing device, the ink cartridge reservoir (102*a*) may include four or more different reservoirs (102*a*) for different colored inks that can be combined to produce a full spectrum of colors.

During the refilling process ink may be added to the cartridge (102) through a port (102*b*). The cartridge port (102*b*) communicates between the refilling apparatus and the ink cartridge reservoir (102*a*). The cartridge port (102*b*) may be any orifice that allows the addition of ink to the cartridge reservoir (102*a*). In some embodiments, the port (102*b*) may also be used to remove ink from the cartridge reservoir (102*a*).

The cartridge (102) is preferably identified by a label (102*c*). The identification label (102*c*) or "e-label" may include any of a number of devices for recording an identification of, and/or information about, the cartridge (102) or the specific printing device from which the cartridge (102) was removed. For example, the identification label (102*c*) may include a barcode, serial number, magnetic strip, memory chip, identification sticker, or other design or symbol that allows the cartridge (102) to be identified. Identification may also involve noting the make, model, and compatible ink types of a given cartridge (102).

FIG. 2 is an illustration of the ink cartridge refilling station (103) according to an embodiment of the present invention. The user inserts an ink cartridge, to which ink is to be added, into a cartridge receptacle (111). The cartridge receptacle (111) preferably holds the cartridge securely to facilitate the process of adding ink to the cartridge. This may simply be an interference fit between the receptacle (111) and the cartridge. Additionally, the receptacle (111) may include a locking mechanism for locking the cartridge in place. It may be desirable to lock the cartridge into the receptacle (111) to prevent a user from removing the cartridge while the refilling process is in progress or before payment for the added ink is received.

The user interfaces with the refilling station (103) through an electronic user interface, which preferably includes a touch screen display panel (104). A touch screen display panel (104) is represented because it is compact, easily customized/localized for specific users and relatively easy to use for most users. Alternatively, the user interface could include a keyboard, keypad, monitor, display, mouse, trackball or any other mechanism that allows the user to send and receive information so as to control the process of adding ink to a cartridge with the refilling station (103).

The touch screen display panel (104) may allow the user to enter information about the cartridge, user, or the printing device in which the cartridge will be used, etc. Such information may be stored in a user profile for future reference. Such user profiles would be stored in a memory unit (not shown) within the refilling station (103). Alternatively this information could be provided via the cartridge's e-label. Through the touch screen display panel (104), the user may select a quality and quantity of ink to be added to the cartridge. The ink is preferably offered at a predetermined price, and the user can complete a monetary transaction for the services rendered by the refilling station (103) using the user interface.

If the cartridge has an identification label or e-label, information relevant to the refilling process may be obtained from the identification label. The cartridge receptacle (111) preferably includes a label reading mechanism (105). The label reading mechanism (105) may be a scanner, magnetic strip reader, or other label sensor that identifies the cartridge. The type of label reading mechanism will correspond to the type or types of labels expected to be used on cartridges serviced by the station (103).

The label reading mechanism (105) notes the cartridge identification and may send relevant information to the touch screen display panel (104). When the cartridge is in the cartridge receptacle (111), the label on the cartridge, if present, is preferably detected automatically and read by the label reading mechanism (105) where possible.

The label reading mechanism (105) in some cases may be unable to determine the identification of the cartridge. This could result because the label is missing, scratched, broken, or of a make incompatible with the filling station (103). In such a case, the ink selection logic unit (106) will preferably interface with the user through the touch screen display panel (104) to determine the cartridge make and ink type to be used, if a variety of inks are available. The ink selection logic unit (106) is further described below. A displayed message on the touch screen (104) may prompt the user to enter the make of the cartridge or select the ink to be used. This message may include a menu from which the user can select among the types of cartridges and ink types supported by the station (103). In some embodiments the touch screen display could provide links to the internet or a database to display images of the various cartridges and/or printers in which they are used to help eliminate problems with the user selecting the wrong ink type when the e-label is missing, damaged or nonexistent.

Additionally, the filing station (103) could be connected to the Internet or other computer network and include an embedded web client/server. The refilling station could then do an online search of the scanned or user-entered cartridge information to determine compatibility and ink and/or cartridge information. The embedded web server/client can also be used to store, in an online database, such information as user preferences, the number of times a particular cartridge has been refilled, quantity per refill, etc. This information would then be available to a number of refilling stations connected to the network containing the on-line database, e.g., the Internet.

As noted above, problems can occur when a user continues to refill and use a cartridge after components of the cartridge have worn out, i.e., beyond the useful life of the cartridge. To avoid these problems, the refilling station (103) of the present invention preferably includes a cartridge diagnostic unit (107). The cartridge diagnostic unit (107) may identify the condition of the cartridge, measure the refillable volume within the cartridge reservoir and calculate the projected useful life of the cartridge. This information may be provided to the user through the touch screen display unit (104). The diagnosis of the cartridge may also include reference to records kept within the refilling station that document how many times that particular cartridge has been serviced by the refilling station (103). Records on specific cartridges could be stored on the Internet, allowing a given refilling station (103) to determine how many times a cartridge has been refilled at 2 or more different refilling stations (103).

The refilling station (103) preferably uses all available information to make decisions about filling the cartridge. The available information is processed by an ink selection logic unit (106). The ink selection logic unit (106) may receive information from the label reading mechanism (105), the diagnostic unit (107) and from the user via the touch screen display unit (104) or other user interface device. Using information from these sources, the logic unit (106) controls such determinations as the ink type to use in filling the cartridge, the ink quality to use if various options are available, when to begin the refilling process, recognition of an unidentified cartridge or unusable cartridge, and when to dispense a receipt to the user, etc.

The refilling mechanism (108) is controlled by the ink selection logic unit (106) and adds ink to the cartridge in the receptacle (111). The cartridge receptacle (111) may secure the ink cartridge so that ink flows smoothly from the ink reservoirs (109) into the refilling mechanism and then into the cartridge receptacle through the cartridge port. The refilling mechanism (108) may or may not completely refill the cartridge in this process. The refilling station (103) may also suggest other ink dispensers (kiosks) and ink types if the cartridge is not compatible (Needs Legalization) with the specific refilling station (103) or if that particular station does not have enough ink to fill the cartridge.

Ink reservoirs (109*a*, 109*b*, 109*c*, 109*d*) are shown to represent the different types of ink that may be available to the refilling mechanism (108). For example, the first ink reservoir (109*a*) may contain black ink used strictly for monochrome print cartridges. The second, third, and fourth ink reservoirs (109*b, c, d*) may contain differently colored inks for refilling the multiple reservoirs in a color ink cartridge respectively. A refilling station (103) may contain many more ink reservoirs (109*a–d*) than are shown in the present embodiment to provide the user with a choice among different brands or qualities of ink. Ink may flow directly from the reservoirs (109) to the refilling mechanism (108). The refilling mechanism (108) then injects the ink into the cartridge in the receptacle (111).

The refilling station (103) may allow the user to differentially fill a cartridge according to specific needs. For example, the station (103) may allow the user to specify a number of pages to be printed and add ink to the cartridge sufficient to print such a volume. In many cases the user may have a budgeted amount of funds to spend in refilling the cartridge. In such a case, the refilling station (103) may add ink corresponding to a specific monetary amount specified or offered by a user.

A record of money spent during the transaction may be kept or shared online, and the station (103) preferably includes means for producing a hard-copy record of the transaction. This printed record is preferably produced, for example, by a receipt and diagnostic printer (110) in the station (103). The printed record may typically include the fees charged for refilling the cartridge, but may also include, for example, additionally or alternatively, diagnostic information on the cartridge, ink selection information, etc. Any information provided through the touch screen display panel (104) may be included on a printed record of the transaction.

Figure 3:
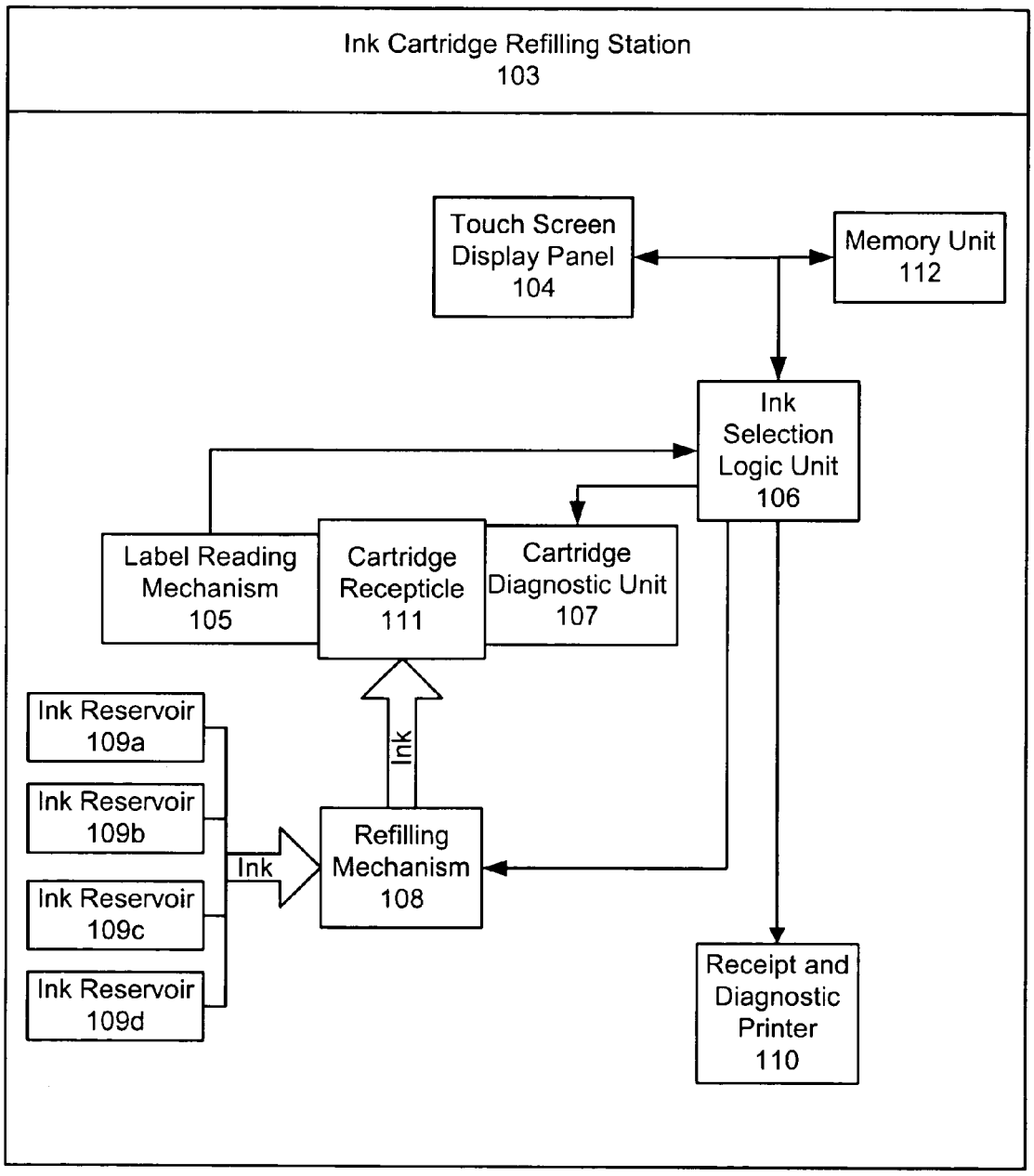
FIG. 3 is an illustration of a second embodiment of an ink cartridge refilling station according to the present invention.

FIG. 3 illustrates an additional embodiment according to the present invention of a print cartridge refilling station (103). The embodiment of FIG. 3 is similar to that of FIG. 2. Therefore, a redundant explanation of elements of the cartridge refilling station (103) described in FIG. 2 will be omitted in describing FIG. 3.

In the embodiment of FIG. 3, a memory unit (112) is included. The memory unit (112) may be any memory type or system that allows for the storage of information, for example, information about a user or cartridge. The memory unit (112) may include a hard disk drive, a floppy disk drive, a read/write compact disk drive, random access memory (RAM), semiconductor memory or other memory systems that allows information to be easily stored and retrieved for use in the ink cartridge refilling station (103).

The memory unit (112) may be used to store a user or cartridge profile and other important information. This information may include the type of cartridges filled by a particular user, the refill history of a particular cartridge, ink preferences of the user, payment preferences of the user, funds a user has deposited with the refilling station or system, credit information for the user, and identification of the user such as a personal identification number for purposes of accessing credit or deposited funds available through the station (103). The memory unit (112) may allow the user to store desired information for ease of use during the refilling process or additional transactions carried out on an ink cartridge refilling station (103).

Figure 4:
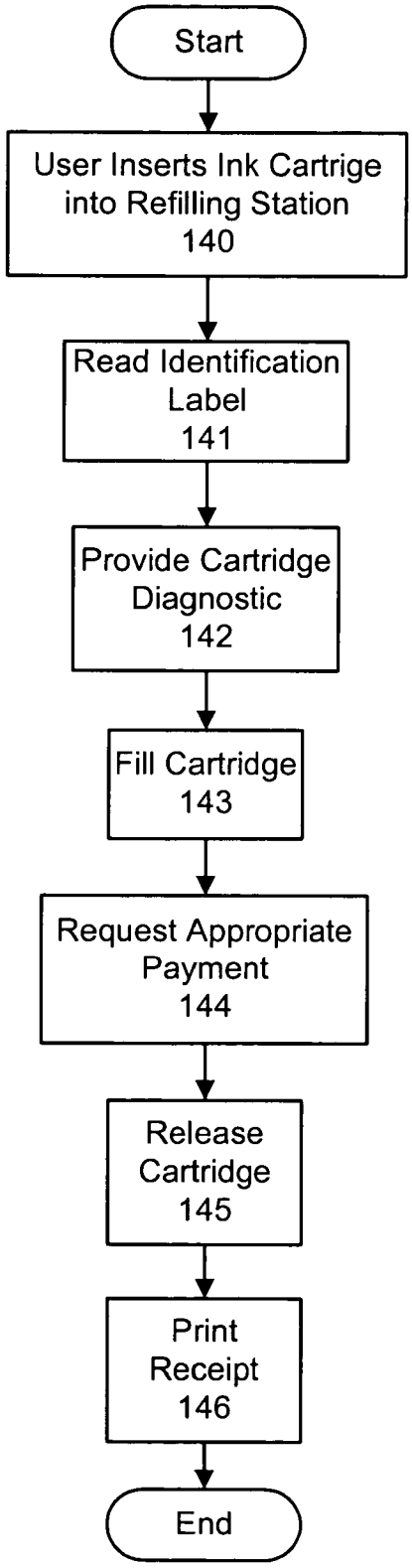
FIG. 4 is a flowchart illustrating a method of operating the system illustrated in FIG. 2 in accordance with an embodiment of the present invention.

FIG. 4 is a flow chart illustrating a preferred method of operating the system illustrated in FIGS. 2 and 3 in accordance with principles of the present invention. As shown in the example of FIG. 4, the process may begin when the user inserts the ink cartridge into the refilling station (140).

The refilling station or kiosk, upon detection of a cartridge inserted in the station, may automatically direct the label reading mechanism to look for and read the identification label expected on the cartridge (141). The identification process may involve identifying the label with a scanner, magnetic strip reader, or any other device that can successfully read the identification label. If the label is absent or unreadable, the process continues to gather relevant information in other ways.

Next, the cartridge diagnostic unit may perform diagnostics (142) that determine the condition of the cartridge. Additionally, the cartridge diagnostic may determine present ink level, expected useful life, and any other data that will be useful to the user or the refilling station in determining the refill parameters of the cartridge. The cartridge may then be filled (143) by the refilling mechanism.

When the refilling mechanism has filled the cartridge (143) according to specification, the refilling station may then request appropriate payment (144) for the transaction. Payment may be made, for example, by depositing the funds for the refill, debiting previously deposited funds or charging a credit account for the refill. As will be appreciated, this step of obtaining payment may be performed before any ink is added to the cartridge. Once the transaction is completed the cartridge may be released (145) to the user by the cartridge receptacle.

A user may desire to see the results of the cartridge diagnostic and keep a receipt of the transaction. After the removal of the cartridge, the user may receive a hardcopy print out from the receipt and diagnostic printer (146). This hard copy may show such things as price, payment method, prior ink volume, ink type, and predicted useful life of the cartridge.

Figure 6:
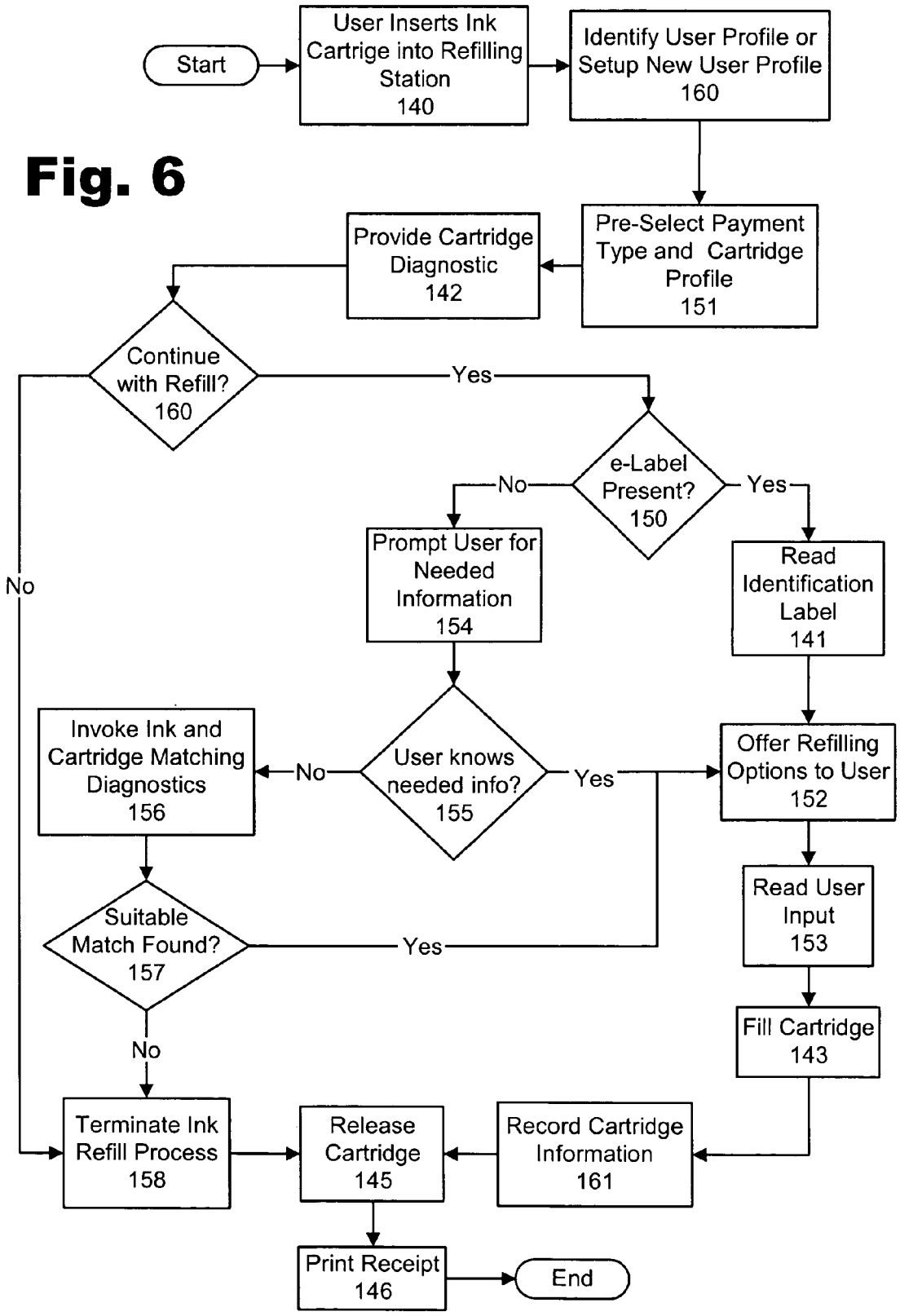
FIG. 6 is a flowchart illustrating a method of operating the system illustrated in FIG. 3 in accordance with still another embodiment of the present invention.

Additional preferred methods of operating embodiments of the present invention are described in FIGS. 5 and 6. A redundant explanation of method steps already described above will be omitted in describing FIG. 5 and FIG. 6.

The method steps of FIG. 5 begin as the user initiates the process by inserting the cartridge into the refilling station (140). The station may then automatically look for an identification label (150). If a label is present, the station may read the label (141) to identify the cartridge, afterwards it may run a cartridge diagnostic (142). The cartridge diagnostic unit may perform diagnostic tests that evaluate the condition of the cartridge.

The user may then be asked to provide a preferred payment type and enter information for a cartridge profile (151). This process may include asking whether the user will be paying for the transaction with a credit card or other account, or asking the user to deposit funds to pay for the refill. The user may also be prompted to enter information about the cartridge, such as, how many times the cartridge has been refilled previously, and any other cartridge specific information that was not retrievable from the e-label. As described above, the station could also do an online search to obtain information about the cartridge based on a stored user or cartridge profile generated at another refilling station or stations.

The identification label, diagnostic information, and cartridge profile may be processed by the ink selection logic unit and sent to the touch screen display unit. The refilling station may then offer refilling options to the user (152). These options may include such things as available volume for consumables, price per ink unit, ink type, and ink quality. The user may then use this information in conjunction with personal needs to make a selection. The refilling station reads the user's input (153) and makes appropriate determinations before continuing with the refilling process (143).

If a label is not automatically found (150) by the label reading mechanism, the user may be prompted to input the information about the cartridge (154). If the user knows the information about the cartridge needed by the system (155), the system reads the input and resumes by offering refilling options to the user (152) and then continues with the refill as described above.

However, if the user is unaware of the needed information (155) the refilling station invokes ink and cartridge matching diagnostics (156). These diagnostics may involve studying the cartridge with diagnostic equipment to determine its type, if possible. If a suitable match is found (157), the touch screen display panel offers the refilling options to the user (152) and continues the refilling process as described above.

If a suitable match is not found (157) for the ink and cartridge type the ink refill process may be terminated (158). The cartridge is then released (145) and any useful information may be printed in the form of a receipt (146).

FIG. 6 is a flow chart illustrating a second preferred method of operating embodiments of the present invention. Immediately after the cartridge is inserted into the refilling station (140), the refilling station may identify a user profile or allow the user to setup a new profile (160), if desired. Identification of the appropriate user profile may be accomplished, for example, by swiping or inserting an identification card into the refilling station, entering a personal identification number (PIN), scanning a biometric characteristic of the user, or any other means of identifying a user. In some embodiments, the refilling station may be one of a system of stations distributed throughout a geographic area. In such a case, the stations would preferably have some means of sharing user profiles so that a user profile created at any one refilling station in the system could be accessed from any other station in the system.

After the user profile is identified, as in the previous embodiment, the refilling station then prompts the user to pre-select a payment type or make payment and, perhaps, select a cartridge profile (151). Next, the refilling station performs a cartridge diagnostic (142). If the cartridge needs to be refilled and is in good condition, the user may then be shown the information on the touch screen display and asked if they want to proceed with the refilling process (160). If the user inputs "yes", the process continues by reading the identification label (141) and offering refilling options to the user (152) as previously described.

After the cartridge has been filled (143), the refilling station may store updated cartridge and user information (161) in the memory unit. This information may be used to determine users needs, and record a transactions for subsequent visits.

However, if the user chooses "no" when asked if they want to continue with the refill (160), the ink refilling process may be terminated (158) and the corresponding user receipt printed (146). Additionally, the station may suggest an alternative ink type, perhaps available at another refilling station, as appropriate.

The preceding description has been presented only to illustrate and describe the invention. It is not intended to be exhaustive or to limit the invention to any precise form disclosed. Many modifications and variations are possible in light of the above teaching.

The embodiments shown were chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. An ink cartridge refilling system comprising:

a receptacle for receiving an ink cartridge;

a supply of ink;

a refilling mechanism for automatically adding ink to said ink cartridge from said supply of ink; and a user interface for controlling said adding of ink to said ink cartridge;

wherein said user interface is configured to allow said user to pay for adding ink to said ink cartridge.

2. The refilling system of claim 1, wherein said user interface comprises a touch screen for displaying information and receiving user input.

3. The refilling system of claim 1, further comprising a memory unit for storing information sent and received from said user interface.

4. The refilling system of claim 1, wherein said user interface is configured to allow a user to select a quantity of ink to be added to said ink cartridge.

5. The refilling system of claim 1, wherein said user interface is configured to allow a user to select a quality of ink to be added to said ink cartridge.

6. A method of adding ink to an ink cartridge, said method comprising:

placing said ink cartridge in an ink cartridge refilling system;

ascertaining information about said ink cartridge; and if said information about said ink cartridge matches predetermined parameters, refusing to add ink to said cartridge with an automated refilling mechanism of said ink cartridge refilling system;

wherein said predetermined parameters include incompatibility, cartridge damage, cartridge warranty and cartridge life.

7. An ink cartridge refilling system comprising:

a receptacle for receiving an ink cartridge;

a supply of ink;

a refilling mechanism for automatically adding ink to said ink cartridge from said supply of ink; and a label reading mechanism for reading an identification label on said ink cartridge;

wherein said identification label indicates a make or model of said ink cartridge.

8. An ink cartridge refilling system comprising:

a receptacle for receiving an ink cartridge;

a supply ink;

a refilling mechanism for automatically adding ink to said ink cartridge from said supply of ink;

a label reading mechanism for readings an identification label on said ink cartridge; and a user profile stored in said refilling system, wherein said user profile is associated with a particular ink cartridge as identified by said identification label on said ink cartridge.

9. The refilling system of claim 8, wherein said user profile comprises information for obtaining payment from a user for ink added to said ink cartridge.

10. The refilling system of claim 8, wherein said user profile comprises a history of said ink cartridge.

11. The refilling system of claim 8, wherein said user profile comprises information regarding a printing device in which said ink cartridge is used.

12. An ink cartridge refilling system comprising:

a receptacle for receiving an ink cartridge;

a supply of ink;

a refilling mechanism for automatically adding ink to said ink cartridge from said supply of ink; and a receipt printer;

wherein said receipt printer is configured to print a receipt for payment of ink added to said ink cartridge.

13. An ink cartridge refilling system comprising:

a receptacle for receiving an ink cartridge;

a supply of ink;

a refilling mechanism for automatically adding ink to said ink cartridge from said supply of ink; and a receipt printer;

wherein said receipt primer is configured to print a receipt describing the ink added to said ink cartridge.

14. An ink cartridge comprising:

a reservoir for holding a supply of ink; and an input port communicating with said reservoir, said port being configured to receive ink from an automated ink refilling system; and an identification label, wherein said identification label provides information about said cartridge to said refilling system;

wherein said identification label indicates a make or model of said ink cartridge.

* * * * *

UNITED STATES PATENT AND TRADEMARK OFFICE

CERTIFICATE OF CORRECTION

PATENT NO. : 6,973,943 B2
APPLICATION NO. : 10/796513
DATED : December 13, 2005
INVENTOR(S) : Sesek et al.

It is certified that error appears in the above-identified patent and that said Letters Patent is hereby corrected as shown below:

In the Claims

Col. 9 (line 18), delete “readings” and insert therefor --reading--.

Signed and Sealed this

Fifteenth Day of August, 2006

JON W. DUDAS
*Director of the United States Patent and Trademark Office*